US009945614B2

(12) United States Patent
Foerster et al.

(10) Patent No.: US 9,945,614 B2
(45) Date of Patent: Apr. 17, 2018

(54) HEAT EXCHANGER WITH HIGH PRESSURE PHASE REFRIGERANT CHANNEL, LOW PRESSURE PHASE REFRIGERANT CHANNEL AND COOLANT CHANNEL

(71) Applicant: MAHLE International GmbH, Stuttgart (DE)

(72) Inventors: Uwe Foerster, Erdmannhausen (DE); Gottfried Duerr, Ludwigsburg (DE); Herbert Hofmann, Stuttgart (DE); Christoph Walter, Stuttgart (DE)

(73) Assignee: MAHLE International GmbH, Stuttgart (DE)

( * ) Notice: Subject to any disclaimer, the term of this patent is extended or adjusted under 35 U.S.C. 154(b) by 237 days.

(21) Appl. No.: 14/725,372

(22) Filed: May 29, 2015

(65) Prior Publication Data

US 2015/0260457 A1 Sep. 17, 2015

Related U.S. Application Data

(63) Continuation of application No. PCT/EP2013/074865, filed on Nov. 27, 2013.

(30) Foreign Application Priority Data

Nov. 29, 2012 (DE) ..... 10 2012 221 925

(51) Int. Cl.
*F25B 7/00* (2006.01)
*F28D 1/04* (2006.01)
(Continued)

(52) U.S. Cl.
CPC ..... *F28D 1/0417* (2013.01); *F25B 39/04* (2013.01); *F25B 40/00* (2013.01); *F28D 7/0066* (2013.01);
(Continued)

(58) Field of Classification Search
CPC ..... F28D 9/0093; F28D 9/005; F28D 7/0066
(Continued)

(56) References Cited

U.S. PATENT DOCUMENTS 6,892,803 B2 5/2005 Memory et al.
7,946,339 B2 5/2011 So et al.
(Continued)

FOREIGN PATENT DOCUMENTS

CN 1692264 A 11/2005
CN 101180510 A 5/2008
(Continued)

OTHER PUBLICATIONS

Chinese Office Action for Chinese Application No. 201380061683.5 dated Jul. 13, 2016, rec'd by applicant dated Sep. 2, 2016, with English translation.

*Primary Examiner* — Frantz Jules
*Assistant Examiner* — Filip Zec
(74) *Attorney, Agent, or Firm* — Muncy, Geissler, Olds & Lowe, P.C.

(57) ABSTRACT

A heat exchanger is provided that includes a first flow channel for a refrigerant, a second flow channel for a refrigerant, and a third flow channel for a coolant, wherein the first flow channel has a first region for initial cooling of the refrigerant and a second region for further cooling of the refrigerant. The refrigerant can flow in a high-pressure phase in the first flow channel and the refrigerant can flow in a low-pressure phase in the second flow channel. A first heat exchange occurs between the refrigerant in the first region of the first flow channel and the coolant in the third flow channel and a second heat exchange occurs between the refrigerant in the second region of the first flow channel and the refrigerant in the second flow channel.

15 Claims, 2 Drawing Sheets

(51) Int. Cl.

| | |
|---|---|
| ***F25B 39/04*** | (2006.01) |
| ***F28D 7/00*** | (2006.01) |
| ***F28D 9/00*** | (2006.01) |
| ***F25B 40/00*** | (2006.01) |
| *F28D 21/00* | (2006.01) |
| *F25B 9/00* | (2006.01) |

(52) U.S. Cl.
CPC ..... *F28D 9/0093* (2013.01); *F25B 9/008* (2013.01); *F25B 2309/061* (2013.01); *F25B 2339/047* (2013.01); *F25B 2500/18* (2013.01); *F28D 2021/0084* (2013.01)

(58) Field of Classification Search
USPC ..... 62/335
See application file for complete search history.

(56) References Cited

U.S. PATENT DOCUMENTS 8,011,201 B2 * 9/2011 Brown ..... F25B 7/00 62/298
2005/0155749 A1 * 7/2005 Memory ..... F28D 9/0075 165/167
2007/0125527 A1 6/2007 Flik et al.
2007/0267169 A1 11/2007 Acre
2008/0121381 A1 * 5/2008 So ..... F28D 1/0333 165/140
2010/0155028 A1 6/2010 Lemee et al.
2011/0185757 A1 * 8/2011 Bittner ..... A47F 3/04 62/216
2012/0060550 A1 3/2012 Mann
2012/0080173 A1 4/2012 Koberstein et al.

FOREIGN PATENT DOCUMENTS

| | | | |
|---|---|---|---|
| CN | 101762132 | A | 6/2010 |
| CN | 102445029 | A | 5/2012 |
| DE | 491 409 | C | 2/1930 |
| DE | 10 2010 048 015 | A1 | 4/2012 |
| DE | 10 2011 083 345 | A1 | 4/2012 |
| DE | 10 2011 007 701 | A1 | 10/2012 |
| FR | 2 924 490 | A1 | 6/2009 |
| JP | H10-19421 | A | 1/1998 |
| WO | WO 2004/113815 | A1 | 12/2004 |

* cited by examiner

HEAT EXCHANGER WITH HIGH PRESSURE PHASE REFRIGERANT CHANNEL, LOW PRESSURE PHASE REFRIGERANT CHANNEL AND COOLANT CHANNEL

This nonprovisional application is a continuation of International Application No. PCT/EP2013/074865, which was filed on Nov. 27, 2013, and which claims priority to German Patent Application No. 10 2012 221 925.0, which was filed in Germany on Nov. 29, 2012, and which are both herein incorporated by reference.

BACKGROUND OF THE INVENTION

Field of the Invention

The invention relates to a heat exchanger comprising a first flow channel for a refrigerant, a second flow channel for a refrigerant, and a third flow channel for a coolant, whereby the first flow channel has a first region for the initial cooling of the refrigerant and a second region for the further cooling of the refrigerant, whereby the refrigerant can flow in a high-pressure phase in the first flow channel and the refrigerant can flow in a low-pressure phase in the second flow channel.

Description of the Background Art

Condensers are used in refrigerant circuits of climate control systems for motor vehicles in order to cool a refrigerant to the condensation temperature and then to condense the refrigerant. This occurs in particular in the case of refrigerants that undergo at least one phase transition from gaseous to liquid in the refrigerant circuit. Condensers routinely have a collector in which a volume of refrigerant can be stored to equalize variations in volume in the refrigerant circuit. As a result, a stable subcooling of the refrigerant can be achieved.

Additional components for drying and/or filtering of the refrigerant are often provided in the collector. The collector is usually disposed on the condenser. The refrigerant that has already flown through part of the condenser flows through the collector. After flowing through the collector, the refrigerant is returned to the condenser and subcooled in a subcooling section to below the condensation temperature.

Condensers are also known in which the refrigerant does not undergo a phase transition. These condensers usually have only one cooling section in which the refrigerant is brought into thermal contact with a coolant.

Furthermore, heat exchangers are known downstream of which an internal heat exchanger is connected after the condensation section and the subcooling section. A collector is thereby disposed between the condensation section and the subcooling section. Whereas in the condensation section and the subcooling section heat transfer occurs between a refrigerant and a coolant, in the internal heat exchanger heat transfer occurs between the refrigerant in two different states, namely, in a high-pressure phase and a low-pressure phase.

A disadvantage of the devices known from the prior art is particularly that during use of $CO_2$ (R744) as the refrigerant high pressures arise within the refrigerant circuit, which stress the heat exchangers known thus far beyond their stress limits.

SUMMARY OF THE INVENTION

Therefore, it is an object of the present invention to provide a heat exchanger which can be subjected to high pressures as they arise, for example, during the use of $CO_2$ (R744). Moreover, the heat exchanger should be characterized by a compact structural form and cost-effective manufacturing.

An exemplary embodiment of the invention relates to a heat exchanger comprising a first flow channel for a refrigerant, a second flow channel for a refrigerant, and a third flow channel for a coolant, whereby the first flow channel has a first region for the initial cooling of the refrigerant and a second region for the further cooling of the refrigerant, whereby the refrigerant can flow in a high-pressure phase in the first flow channel and the refrigerant can flow in a low-pressure phase in the second flow channel, whereby a first heat transfer occurs between the refrigerant in the first region of the first flow channel and the coolant in the third flow channel and a second heat transfer occurs between the refrigerant in the second region of the first flow channel and the refrigerant in the second flow channel.

The temperature of the refrigerant in the high-pressure phase can be reduced further by an additional heat transfer between the refrigerant in its high-pressure phase and the refrigerant in its low-pressure phase. As a result, the cooling performance in the refrigerant circuit can be increased overall.

In an embodiment of the invention, it can be provided that the second region of the first flow channel and the second flow channel form a first unit and the first region of the first flow channel and the third flow channel form a second unit, whereby the first unit and the second unit can be connected as a structural unit.

In an embodiment of the invention, it can be provided that the heat exchanger has an accumulator, which has a storage volume for storing the refrigerant and/or components for filtering and/or drying the refrigerant.

The accumulator serves as a storage medium for the refrigerant. Advantageously it stores the refrigerant in the low-pressure phase therein. It is also used for equalizing refrigerant volume variations or for compensating refrigerant losses, which may arise, for example, due to leaks. In addition, the accumulator advantageously may have devices for drying and/or filtering the refrigerant. This has an advantageous effect on the quality of the refrigerant and thereby also on the efficiency of the refrigerant circuit.

The accumulator can be associated with the heat exchanger.

An association of the additional accumulator with the heat exchanger can be especially advantageous, if the heat exchanger itself must be made as compact as possible. The accumulator in this case can be installed independently of the heat exchanger in the vehicle.

According to an exemplary embodiment of the invention, the refrigerant can transfer from the second region of the first flow channel to the second flow channel that passes through the accumulator.

The refrigerant transfer through the accumulator can assure that refrigerant volume variations can be completely equalized at any time. The efficiency of the refrigerant circuit thus improves overall.

The third flow channel can be adjacent to the first region of the first flow channel and the second flow channel can be adjacent to the second region of the first flow channel.

The arrangement of the flow channels in this way promotes the heat transfer between the refrigerant in the first region of the first flow channel and the coolant in the third flow channel and in addition the heat transfer between the refrigerant in the second region of the first flow channel and the refrigerant in the second flow channel.

The first unit and/or the second unit can be formed with a stacked plate design.

A structure with a stacked plate design is especially simple and especially cost-effective because of the low number of different elements.

The first unit and/or the second unit can be formed with a tube-fin design.

In an embodiment of the invention, it can be provided that the first unit and/or the second unit can be formed by a plurality of tubes, whereby the tubes are arranged adjacent to one another and are at least partially in thermal contact with one another, whereby the refrigerant and/or the coolant can flow through the tubes.

The flowing of the refrigerant and the coolant in the tubes is especially advantageous particularly with respect to the pressure resistance of the heat exchanger. An especially high pressure resistance can be achieved by the use of tubes.

The first unit and/or the second unit can be formed by a plurality of tubes, whereby turbulence inserts are arranged between the tubes, whereby the arrangement of tubes and turbulence inserts is encased by a housing, whereby a coolant and/or a refrigerant can flow through the tubes and a coolant and/or a refrigerant can flow around them.

A structure in which a first fluid flows through a part of the tubes and simultaneously a second fluid flows around the same part of the tubes is especially advantageous, because an especially high heat transfer can be realized in this way.

In particular, a mixed design comprising a unit formed using the stacked plate design and a unit formed using the tube-fin design can combine the advantages of both designs.

An exemplary embodiment of the invention has a heat exchanger formed using a stacked plate design, whereby a heat exchanger block is formed by the stacking of individual plate elements one on top of the other and channels are formed between the plate elements, whereby a first number of channels is allocated to the first flow channel, a second number of the channels is allocated to the second flow channel, and a third number of the channels is allocated to the third flow channel.

The structure with a stacked plate design is especially advantageous, because a large number of identical parts can be used. Depending on the embodiment of the heat exchanger, only the two outer plate elements need to be different from the others. As a result, the cost and production expenditures can be reduced considerably.

One or more flow channels can have one or more redirections in their flow direction, as a result of which the fluid flows in the flow channels can run in a co-current flow and/or in a counter-flow and/or in a cross-flow to one another.

The fluid flows can be directed by deflections in the interior of the heat exchanger. As a result, the heat transfer can be increased considerably and the efficiency of the refrigerant circuit improved.

According to an embodiment, it is advantageous, if the accumulator has the second region of the first flow channel and the second flow channel, whereby a heat transfer occurs between the second region of the first flow channel and the second flow channel within the accumulator.

This type of design is advantageous, because the heat exchanger can be built even more compact as a result, which is advantageous particularly with respect to the available installation space.

A further exemplary embodiment provides that the accumulator and the heat exchanger are made as a structural unit.

A structural unit comprising the accumulator and heat exchanger is advantageous, because the required installation space can be reduced overall. In addition, a simpler installation in the vehicle is possible, because no additional piping between the heat exchanger and the accumulator needs to be provided.

The refrigerant can be, for example, $CO_2$ (R744).

The heat exchanger can have a pressure resistance that allows internal pressures greater than 100 bar.

It is advantageous when, for example, $CO_2$ (R744) is used as the refrigerant, if the heat exchanger can withstand high internal pressures. Pressures of 100 bar and higher can arise during operation with $CO_2$ (R744) as the refrigerant.

The pressure resistance of 100 bar and higher is particularly advantageous for the regions through which the high-pressure refrigerant flows. This pressure resistance can also be advantageous for the region through which the low-pressure refrigerant and the coolant flow.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
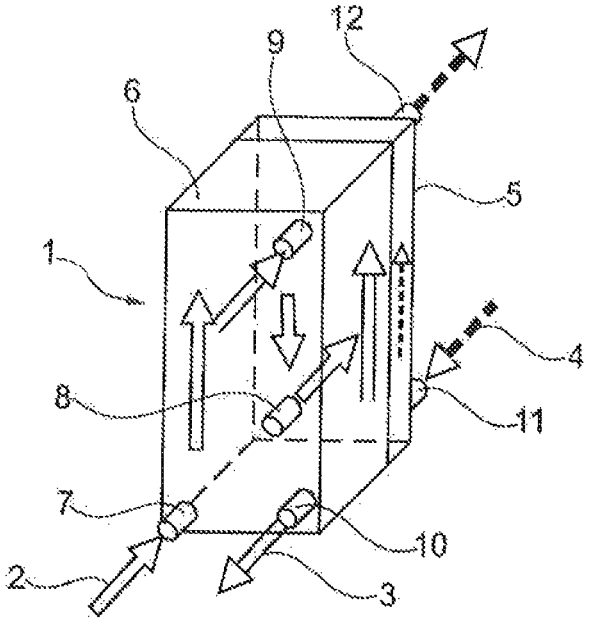
FIG. 1 shows a perspective view of a heat exchanger with an internal cooling section and an internal heat exchanger.

FIG. 1 shows a schematic view of a heat exchanger 1. Heat exchanger 1 is divided into a cooling section 6 and into an internal heat exchanger 5. A refrigerant in a high-pressure phase (high-pressure refrigerant) 2 is brought into thermal contact with a coolant 3 in cooling section 6, so that there is a heat transfer from the high-pressure refrigerant 2 to coolant 3. High-pressure refrigerant 2 is brought into thermal contact with the same refrigerant but in a low-pressure phase (low-pressure refrigerant) 4 in internal heat exchanger 5. High-pressure refrigerant 2 is therefore cooled further in internal heat exchanger 5.

High-pressure refrigerant 2 flows via a fluid inlet 7 into cooling section 6. A plurality of flow channels, through which high-pressure refrigerant 2 flows in part and coolant 3 in part, are arranged in the interior of cooling section 8. A plurality of flow channels are also arranged in internal heat exchanger 5, whereby a number of said flow channels are allocated to low-pressure refrigerant 4 and a further number of the channels are allocated to high-pressure refrigerant 2. Both the flow channels in internal heat exchanger 5 and in cooling section 6 are not shown for reasons of clarity.

The flow channels for high-pressure refrigerant 2, coolant 3, and low-pressure refrigerant 4 can be arranged in the heat exchanger in any order. In this regard, the flow channels of the different fluids can be arranged alternately, for example. Alternatively, an arrangement can also be provided in which a plurality of flow channels for the same fluid are arranged adjacent to one another.

The flow of high-pressure refrigerant 2 through heat exchanger 1 runs along fluid inlet 7 through the flow channels in the interior of cooling section 6, along the flow channels in interior heat exchanger 5, and finally out of fluid outlet 8 out of heat exchanger 1. Coolant 3 flows via fluid inlet 9 into cooling section 6 of heat exchanger 1 and there along the flow channels within cooling section 6 to fluid outlet 10. There it flows out of heat exchanger 1.

Low-pressure refrigerant 4 flows via a fluid inlet 11 into internal heat exchanger 5 and there along the flow channels allocated to it through internal heat exchanger 5. It finally flows via fluid outlet 12 out of internal heat exchanger 5.

Deflections can be provided in the interior of heat exchanger 1, as a result of which the flow direction of the individual fluids is redirected. In this regard, regions can be created in which two fluids flow in cocurrent flow or in counterflow to one another. A skillful arrangement of the flow channels and deflections in the interior of heat exchanger 1 can also achieve that two fluids flow in a crossflow to one another.

High-pressure refrigerant 2 within the refrigerant circuit, which is not shown in FIG. 1, is converted via an expansion valve (also not shown) into a low-pressure phase and thereby into low-pressure refrigerant 4.

Figure 2:
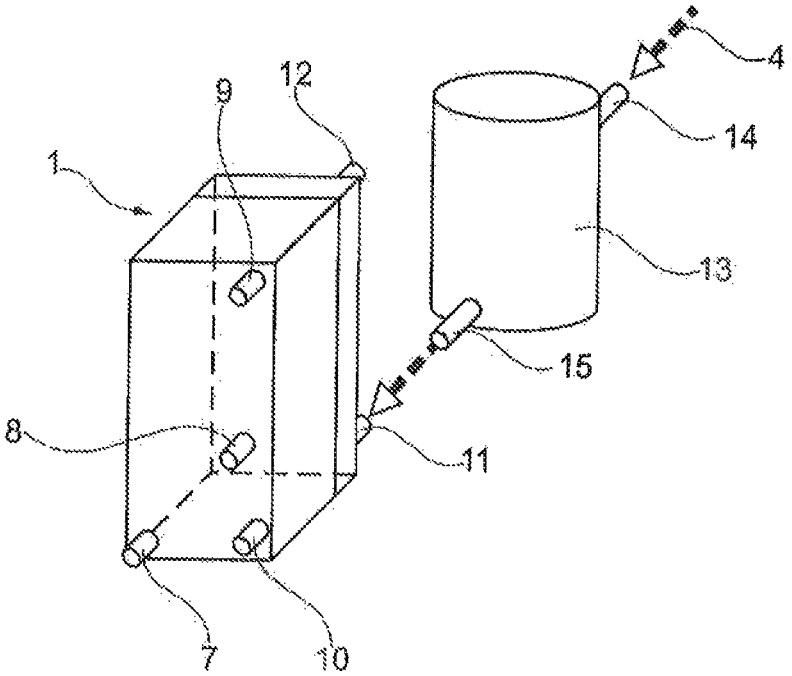
FIG. 2 shows a perspective view of a heat exchanger according to FIG. 1 and an additional accumulator.

FIG. 2 shows a further schematic view of heat exchanger 1, as it was already shown in FIG. 1. The features of heat exchanger 1 that are identical to FIG. 1 are designated with identical reference characters.

An accumulator 13 is shown in addition in FIG. 2. Said accumulator 13 is used for storing low-pressure refrigerant 4, which flows into accumulator 13 via a fluid inlet 14 and flows out of accumulator 13 via a fluid outlet 15. In addition, accumulator 13 may contain components for filtering, cleaning, and drying low-pressure refrigerant 4. A variation in the refrigerant volume within the refrigerant circuit can be equalized via a storage volume in the interior of accumulator 13. This provides for a stable cooling of refrigerant 2, 4 within the refrigerant circuit. Likewise, leaks within the refrigerant circuit can be at least partially compensated.

Accumulator 13 is disposed directly before fluid inlet 11 of heat exchanger 1. Low-pressure refrigerant 4 thus flows out of accumulator 13 directly into internal heat exchanger 5 of heat exchanger 1.

Accumulator 13, as shown in FIG. 2, can be made as a separate part, which is disposed in the vicinity of heat exchanger 1. An integration of the accumulator into the heat exchanger can also be provided in alternative embodiments. The embodiment of the heat exchanger and accumulator in a structural unit is advantageous especially with respect to the required installation space for the structural unit.

Figure 3:
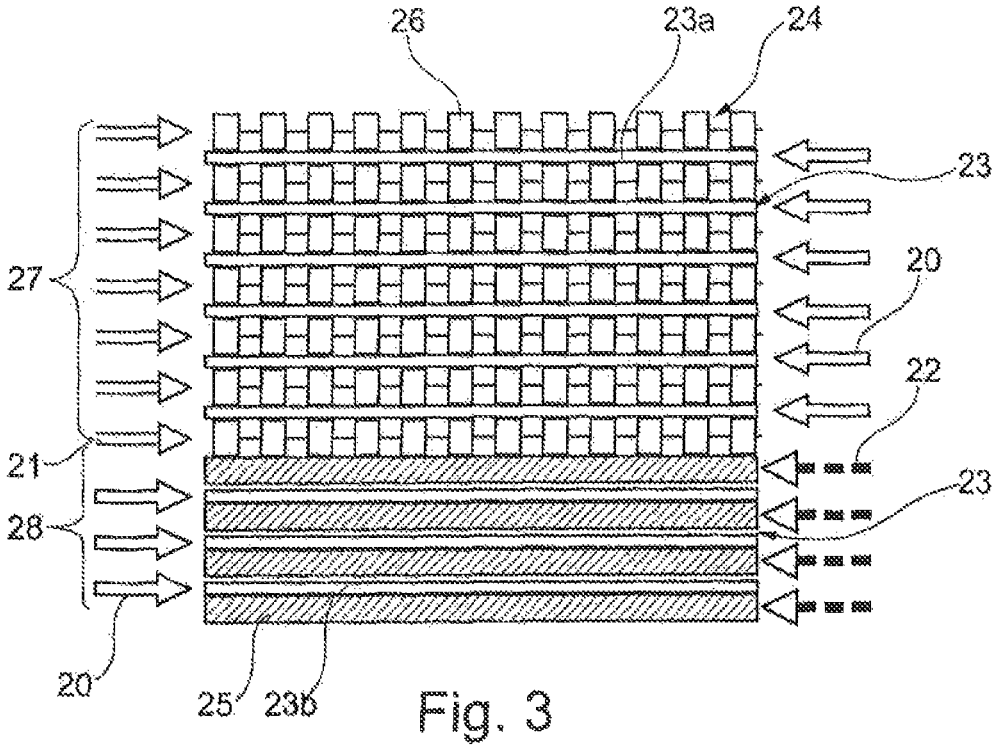
FIG. 3 shows a sectional view through a heat exchanger with a plurality of flow channels for a low-pressure refrigerant, a high-pressure refrigerant, and a coolant.

FIG. 3 shows a sectional view through a heat exchanger. The arrangement of the different flow channels 23, 24, 25 is shown. First flow channel 23, which divides into a first region 23*a* and a second region 23*b*, is allocated to high-pressure refrigerant 20. High-pressure refrigerant 20 comes into thermal contact with a coolant 21 in first region 23*a* of first flow channel 23, as a result of which a heat transfer occurs between high-pressure refrigerant 20 and coolant 21. The heat transfer between high-pressure refrigerant 20 and low-pressure refrigerant 22 occurs in second region 23*b* of first flow channel 23.

To illustrate a heat transfer between first region 23*a* of first flow channel 23 and high-pressure refrigerant 20 and coolant 21 flowing therein, flow channel 23 is in thermal contact with a further flow channel 24. Flow channel 24 in this case has a plurality of fin elements 26, which serve to increase the heat transfer surface.

The example shown in FIG. 3 for the arrangement of the flow channels within a heat exchanger provides that the heat transfer occurs between high-pressure refrigerant 20 and coolant 21 via flow channels in the tube-fin design. In this case, the refrigerant flows through first region 23*a* of flow channels 23, whereby flow channels 24 are arranged between flow channels 23 and are flown through by a coolant such as, for example, ambient air or cooling water. As a result, coolant 21 flows around first region 23*a*.

Coolant 21 flows substantially around first regions 23*a* of flow channels 23, whereas high-pressure refrigerant 20 flows through them. The mode of operation of cooling region 27 corresponds to the customary heat exchanger with the tube-fin design, in which a fluid flows through a first number of tubes, whereas a second fluid flows around this number of tubes.

The arrangement shown in FIG. 3 can be encased by a housing. The coolant can flow through the housing in this case, as a result of which the coolant flows around the tubes through which the refrigerant flows.

The heat transfer between high-pressure refrigerant 20 and low-pressure refrigerant 22 occurs between second region 23*b* of flow channels 23 of high-pressure refrigerant 20 and channels 25 of low-pressure refrigerant 22. The region in FIG. 3, formed by flow channels 24 and first region 23*a* of first flow channels 23, corresponds to cooling section 27. The region in FIG. 3, formed by second region 23*b* of first flow channels 23 and flow channels 25, corresponds to internal heat exchanger 28.

In different embodiments, cooling section 27 can be represented by flow channels brought into thermally conductive contact with one another. In so doing, the use of a liquid coolant can also be provided.

The first unit of the heat exchanger, formed by second region 23*b* of first flow channel 23 and second flow channel 25, and the second unit of the heat exchanger, formed by first region 23*a* of first flow channel 23 and third flow channel 24, can be formed optionally by a structure with a stacked plate design, with a tube-fin design, or by a sequential arrangement of tubes through which the refrigerant or the coolant flows.

Alternatively, an arrangement of tubes between which turbulence inserts are arranged can also be provided, whereby either the refrigerant or the coolant then flows around the tubes and the turbulence inserts. In this case, a housing is advantageously provided, which encases the arrangement of tubes and turbulence inserts.

Figure 4:
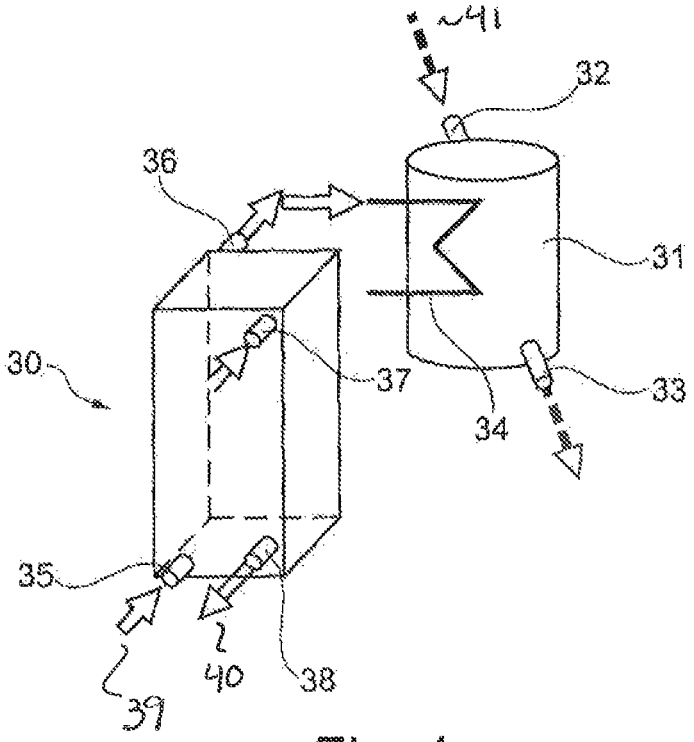
FIG. 4 shows a perspective view of a heat exchanger with a cooling section and an accumulator in which an internal heat exchanger is integrated.

FIG. 4 shows an alternative embodiment of heat exchanger 30. Heat exchanger 30 can also be formed only of a cooling section, in which high-pressure refrigerant 39 is brought into thermal contact with coolant 40. The structure of heat exchanger 30 corresponds substantially to cooling section 6 of heat exchanger 1 in FIG. 1, whereby coolant 40 flows into the heat exchanger 30 via inlet 37 and flows out via outlet 38.

In FIG. 4, an additional accumulator 31 is disposed similar to FIG. 2. A low-pressure refrigerant 41 flows through accumulator 31 via fluid inlet 32 and flows out of fluid outlet 33 out of accumulator 31. In addition, high-pressure refrigerant 39, which enters via inlet 35 and which flows out of fluid outlet 36 of heat exchanger 30, flows into accumulator 31.

Accumulator 31 to this end has in particular second region 34 of the first flow channel, which is brought into thermally conductive contact with low-pressure refrigerant 41. To this end, accumulator 31 may have a plurality of flow channels in its interior.

As also already described in FIG. 2, accumulator 31 in FIG. 4 can be made as a separate part, as is shown. In alternative embodiments, it can also be integrated directly into heat exchanger 30.

In particular, the positioning of the fluid inlets and fluid outlets represents only one possible arrangement. The fluid inlets and fluid outlets can be arranged arbitrarily on the heat exchanger and the accumulator. Advantageous solutions result particularly from the selection of the internal structure of the heat exchanger. Thus, in an embodiment with the stacked plate design, the fluid inlets and fluid outlets are advantageously arranged on the two outer plate elements closing the stack.

The refrigerant circuit surrounding the heat exchanger is not shown in any of FIGS. 1 to 4. The exemplary embodiments in FIGS. 1 to 4 are only exemplary in nature and do not represent a definitive recital and illustration of the embodiments. They are not limiting in nature.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

a first flow channel for a refrigerant;

a second flow channel for the refrigerant; and a third flow channel for a coolant, wherein a first region is provided for an initial cooling of the refrigerant and a second region is provided for further cooling of the refrigerant, wherein the refrigerant flows in a high-pressure phase in the first flow channel and flows in a low-pressure phase in the second flow channel, wherein a first heat transfer occurs in the first region between the refrigerant in a first portion of the first flow channel and the coolant in the third flow channel and a second heat transfer occurs in the second region between the refrigerant in a second portion of the first flow channel and the refrigerant in the second flow channel, wherein both the first portion of the first flow channel and the third flow channel are provided in the first region and both the second portion of the first flow channel and the second flow channel are provided in the second region, and wherein the refrigerant in the second portion of the first flow channel exits the second region via a first fluid outlet and the refrigerant in the second flow channel exits the second region via a second fluid outlet.

2. The heat exchanger according to claim 1, wherein the second portion of the first flow channel and the second flow channel in the second region form a first unit and the first portion of the first flow channel and the third flow channel in the first region form a second unit, and wherein the first unit and the second unit are connected as a structural unit.

3. The heat exchanger according to claim 1, wherein the heat exchanger further comprises an accumulator that has a storage volume for storing the refrigerant and at least one of a filter for filtering or a dryer for drying the refrigerant.

4. The heat exchanger according to claim 3, wherein the accumulator is associated with the heat exchanger.

5. The heat exchanger according to claim 3, wherein the second region, in which the second heat transfer from the second portion of the first flow channel to the second flow channel occurs, is provided in the accumulator.

6. The heat exchanger according to claim 2, wherein at least one of the first unit or the second unit are formed with a stacked plate design.

7. The heat exchanger according to claim 2, wherein at least one of the first unit or the second unit are formed with a tube-fin design.

8. The heat exchanger according to claim 2, wherein the first unit and the second unit are formed by a plurality of tubes, wherein the plurality of tubes are arranged adjacent to one another and are at least partially in thermal contact with one another, and wherein the refrigerant or the coolant flows through the plurality of tubes.

9. The heat exchanger according to claim 2, at least one of the first unit or the second unit are formed by a plurality of tubes, wherein turbulence inserts are arranged between the plurality of tubes, wherein an arrangement of the plurality of tubes and turbulence inserts is encased by a housing, wherein the coolant or the refrigerant flows through the plurality of tubes and the coolant or the refrigerant flows around them.

10. The heat exchanger according to claim 2, wherein at least one of the first, second or third flow channels has one or more redirections within, as a result of which the fluid flows in the at least one of the first, second or third flow channels in a co-current flow, in a counter-flow or in a cross-flow to one another.

11. The heat exchanger according to claim 3, wherein the accumulator and the heat exchanger are made as a structural unit.

12. The heat exchanger according to claim 2, wherein the refrigerant is $CO_2$ (R744).

13. The heat exchanger according to claim 2, wherein the heat exchanger has a pressure resistance that allows internal pressures greater than 100 bar.

14. The heat exchanger according to claim 5, wherein the second region is provided in the accumulator, such that both the second portion of the first flow channel and the second flow channel flow through the accumulator.

15. The heat exchanger according to claim 14, wherein the accumulator has a first fluid inlet for the refrigerant of the first flow channel and a second fluid inlet for the refrigerant of the second flow channel, and the accumulator has a first fluid outlet for the refrigerant of the first flow channel and a second fluid outlet for the refrigerant of the second flow channel.

* * * * *